US011185751B2

(12) United States Patent
Wood et al.

(10) Patent No.: US 11,185,751 B2
(45) Date of Patent: Nov. 30, 2021

(54) MULTI-ASSEMBLY BOARD HOLDING APPARATUS

(71) Applicants: Darin Lee Wood, Conway, AR (US); Barbara Sue Wood, Conway, AR (US)

(72) Inventors: Darin Lee Wood, Conway, AR (US); Barbara Sue Wood, Conway, AR (US)

( * ) Notice: Subject to any disclaimer, the term of this patent is extended or adjusted under 35 U.S.C. 154(b) by 307 days.

(21) Appl. No.: 16/521,408

(22) Filed: Jul. 24, 2019

(65) Prior Publication Data

US 2020/0030677 A1 Jan. 30, 2020

Related U.S. Application Data

(60) Provisional application No. 62/702,506, filed on Jul. 24, 2018.

(51) Int. Cl.

| | |
|---|---|
| ***A63B 69/00*** | (2006.01) |
| *A63B 1/00* | (2006.01) |
| *A63B 71/02* | (2006.01) |

(52) U.S. Cl.

CPC ..... *A63B 69/004* (2013.01); *A63B 1/00* (2013.01); *A63B 2069/0042* (2013.01); *A63B 2071/025* (2013.01); *A63B 2210/50* (2013.01); *A63B 2225/09* (2013.01); *A63B 2225/093* (2013.01)

(58) Field of Classification Search

CPC ..... A63B 69/004; A63B 2210/50; A63B 2069/0042; A63B 2071/025; A63B 2225/09; A63B 2225/093; A63B 1/00; G09B 19/0038

See application file for complete search history.

(56) References Cited

U.S. PATENT DOCUMENTS

| | | | | | |
|---|---|---|---|---|---|
| 4,757,989 | A * | 7/1988 | Bauer, Jr. | A63B 69/004 | 108/145 |
| 4,776,584 | A * | 10/1988 | Tilley | A63B 69/004 | 294/131 |
| 4,787,625 | A * | 11/1988 | Chaloux | A63B 69/004 | 482/87 |
| 4,817,941 | A * | 4/1989 | McCorry | A63B 69/004 | 482/87 |
| 4,836,533 | A * | 6/1989 | Dong | A63B 69/004 | 482/83 |
| 4,889,334 | A * | 12/1989 | Partlo | A63B 69/004 | 482/83 |

(Continued)

*Primary Examiner* — Sundhara M Ganesan
(74) *Attorney, Agent, or Firm* — Wright, Lindsey & Jennings LLP; K. Brandon Middleton

(57) ABSTRACT

An apparatus for holding one or more boards during martial arts training, includes a support frame configured to hold various training station assemblies, each of the station assemblies structured differently to provide different training functionality, the first station including a number of plates that work together to hold the board(s) at a position such that upon striking of the board(s) a portion of the first station collapses to allow for follow through during the striking motion, the second station including a number of plates that work together to the board(s) at a desired and modifiable angle, and the third station being configured to hold the board(s) at a hanging position beyond the profile of the support frame, which may be positioned on a support base resting on a horizontal surface such as a floor or may be directly affixed to a vertical surface such as a wall.

11 Claims, 13 Drawing Sheets

(56) References Cited

U.S. PATENT DOCUMENTS

| | | | | | |
|---|---|---|---|---|---|
| 4,973,045 | A * | 11/1990 | Heberer | A63B 69/004 | 482/83 |
| 5,254,062 | A * | 10/1993 | Hoffman | A63B 69/004 | 482/83 |
| 5,362,289 | A * | 11/1994 | Holt | A63B 69/004 | 428/58 |
| 5,415,371 | A * | 5/1995 | Kirchner | A63B 69/004 | 211/41.1 |
| 5,458,551 | A * | 10/1995 | Shenton | A63B 69/004 | 482/83 |
| 5,476,433 | A * | 12/1995 | Bruner | A63B 69/004 | 482/83 |
| 5,665,035 | A * | 9/1997 | Tumminia | A63B 21/0552 | 482/83 |
| 5,863,279 | A * | 1/1999 | Pouliot | A63B 69/004 | 482/83 |
| 6,149,553 | A * | 11/2000 | Antoszewski | A63B 69/004 | 434/247 |
| 6,217,490 | B1 * | 4/2001 | Wurtak | A63B 69/004 | 248/316.4 |
| 7,121,986 | B1 * | 10/2006 | O'Dowd | A63B 69/004 | 482/83 |
| 7,559,880 | B1 * | 7/2009 | Calhoun | A63B 69/004 | 482/83 |
| 7,727,127 | B1 * | 6/2010 | Arrington | A63B 69/004 | 482/83 |
| 2010/0252975 | A1 * | 10/2010 | Wisniewski | A63B 69/004 | 269/74 |

* cited by examiner

FIG. 7B
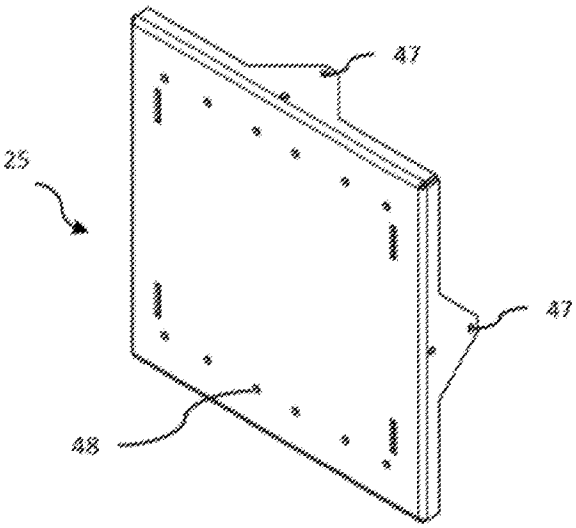
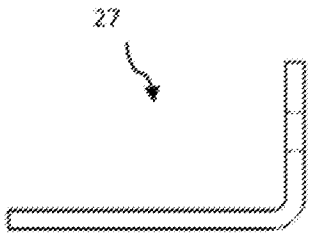
FIG. 7D
FIG. 7A
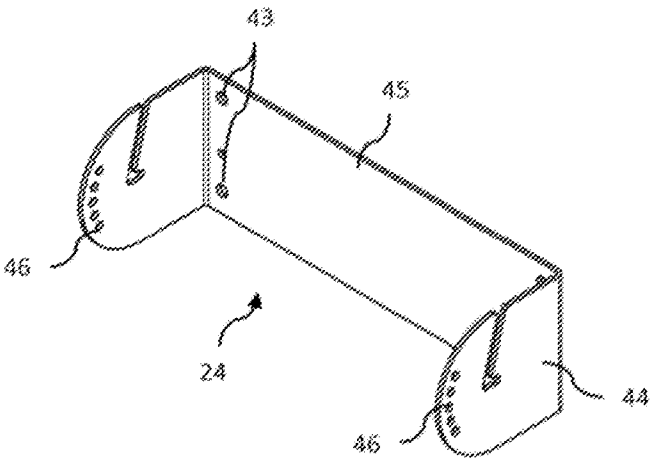
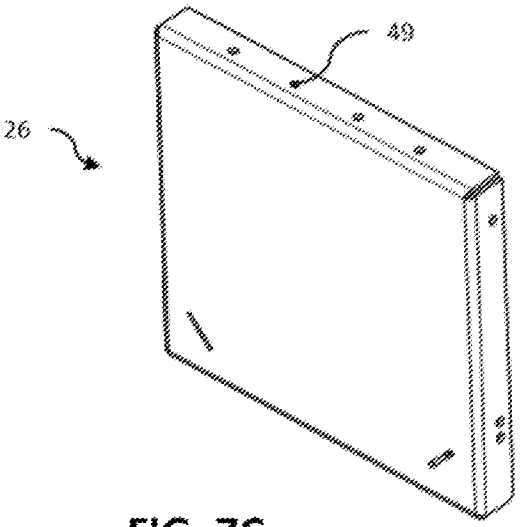
FIG. 7C

MULTI-ASSEMBLY BOARD HOLDING APPARATUS

CROSS REFERENCE TO RELATED APPLICATIONS

This application claims the benefit of U.S. Provisional Patent Application No. 62/702,506 filed on Jul. 24, 2018, and entitled "Board Holding System and Apparatus." Such application is incorporated by reference herein in its entirety.

STATEMENT REGARDING FEDERALLY SPONSORED RESEARCH OR DEVELOPMENT

Not applicable.

BACKGROUND OF THE INVENTION

The practice of martial arts has been around for centuries and is widely recognized as being useful for self-defense and law-enforcement applications and for entertainment and stress relief purposes. Many forms of martial arts (which, for example, may include Tae Kwon Do, Karate, Kung Fu, or others) use kick training to develop and improve kicking techniques, such as power, timing and speed. Training in appropriate kicking techniques is a vital part of the development of speed, accuracy, strength, and reflexes—all of which allow the martial artist to analyze any given situation and react appropriately.

Many martial artists use kick pads, bags, boards, or other martial artists for their kick training practices, with board kicking being a popular choice among martial artists who can showcase their kicking skill progress by breaking the boards in the classroom or at competitions. When it comes to board breaking, however, there are difficulties that arise, particularly in training classrooms. One problem is that in many cases the board breaking lessons require a second martial artist (or even multiple additional martial artists) to hold the board in place for the training martial artist to kick. Unfortunately, in many cases there are not enough people in the classroom that can hold the boards in place and even if there are, this reduces the board holder's time actually practicing his or her own kicking skills.

With this in mind, some devices for holding the kicking boards have been developed, but those devices introduce their own problems into the training. For example, the existing board holding devices are limited to just one holding position, meaning that the martial artist gets practice at only one position—which reduces the martial artists well-roundedness in technique and skills. These existing devices also have a disproportional footprint in light of their usefulness, meaning that they take up a large amount of space in the classroom while only able to hold a few boards. Many martial art studios or classrooms do not have the space required to use these devices. Some board holding devices even still require a person to hold the device, which limits the number of boards that can be held.

These devices and existing board holding techniques are not sufficient when it comes to different levels of martial arts training. In martial arts, there are many different skill levels of the martial artists, which are denoted by different level belts. In order to move upward in belt levels, testing is done to determine if the martial artist meets certain skill requirements. In many cases there are increasing requirements for breaking boards as the skill level increases, with more boards needing to be held as the skill level of the student increases. Many of the existing devices cannot achieve these multiple board demands and therefore are limited in their use for skill testing. Finally, because of the lack of availability of appropriate board holding devices, many martial artists are left holding boards for others, and thus may incur injuries to their head, finger, hands, arms, legs, or feet due to the mistake or inaccuracy of the board kicker. A board holding device that is capable of solving these problems is needed.

BRIEF SUMMARY OF THE INVENTION

Generally speaking, the present invention is directed to a board holding apparatus useful for martial arts training that is configured to hold one or multiple boards in different positions (either individually or simultaneously), allowing martial artists to use a variety of foot and hand techniques for training or demonstration purposes. It is an object of the present invention to provide a board holding apparatus that is capable of allowing for the breaking of single or multiple boards. It is also an object of the preset invention to provide a board holding apparatus that is capable of holding boards in a variety of positions and at a variety of heights. In this regard, the present invention includes a number of assemblies that can be selectively utilized to provide training for different techniques and at different positions.

Finally, it is an object of the present invention to provide a board holding apparatus that takes up a small amount of space and that can be easily transported or stored. These and other objects, features, and advantages of the present invention will become better understood from a consideration of the following detailed description of the preferred embodiments and appended claims in conjunction with the drawings as described following:

BRIEF DESCRIPTION OF THE DRAWINGS

FIG. 7A shows one embodiment of the mounting bracket of the second station assembly.

FIG. 7B shows one embodiment of the back plate of the second station assembly.

FIG. 7C shows one embodiment of the top and bottom plates of the second station assembly.

FIG. 7D shows one embodiment of the top and bottom plate support angle of the second station assembly.

DETAILED DESCRIPTION OF THE INVENTION

Figure 1:
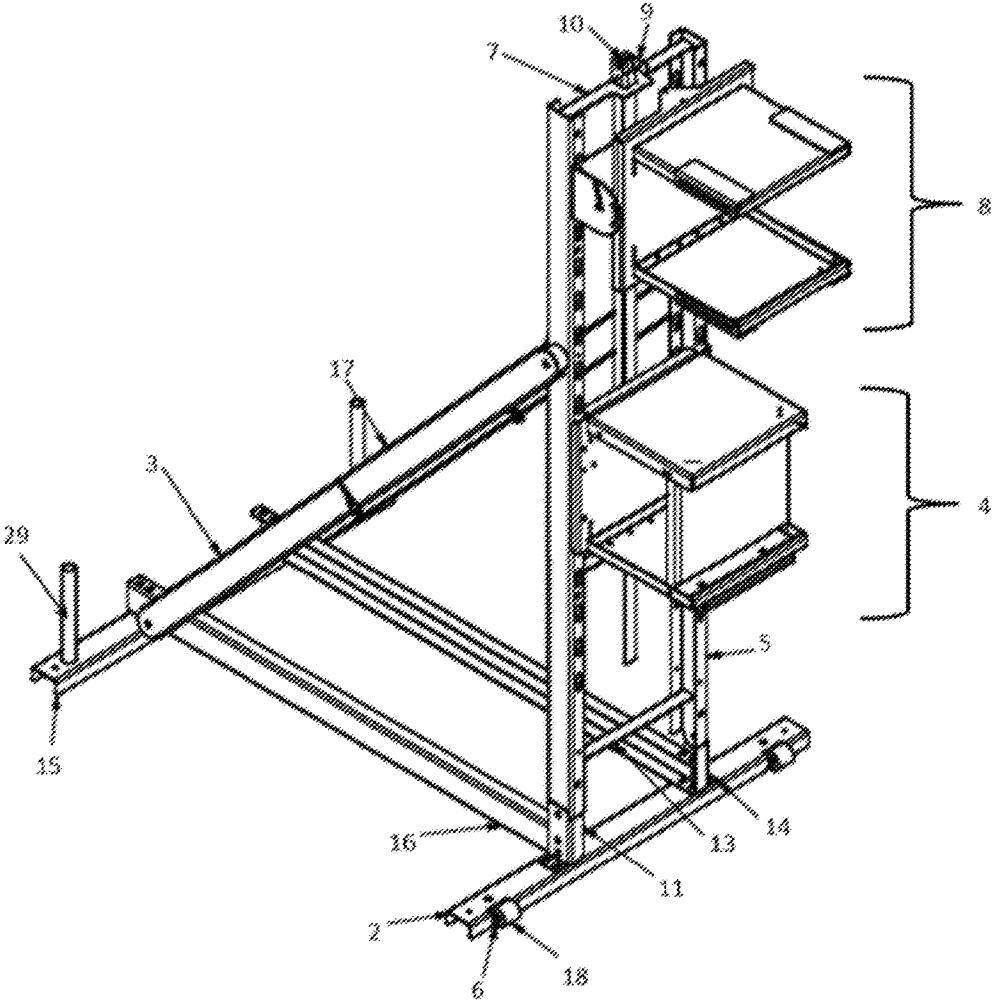
FIG. 1 shows one embodiment of the apparatus of the present invention from a front perspective view.
Figure 2B:
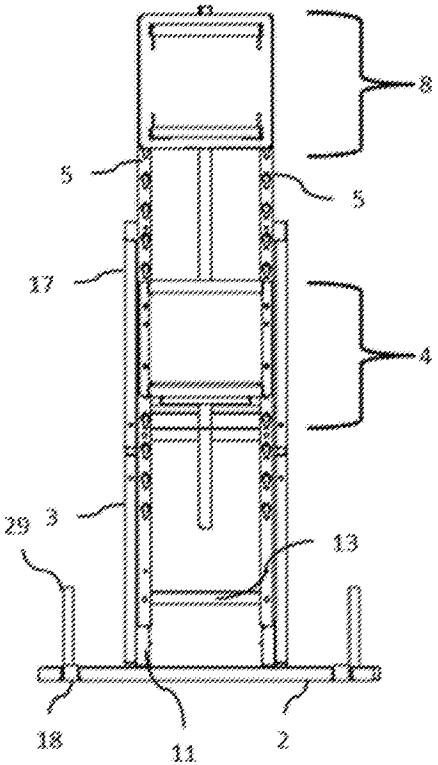
FIG. 2B shows one embodiment of the apparatus of the present invention from a front view.
Figure 2A:
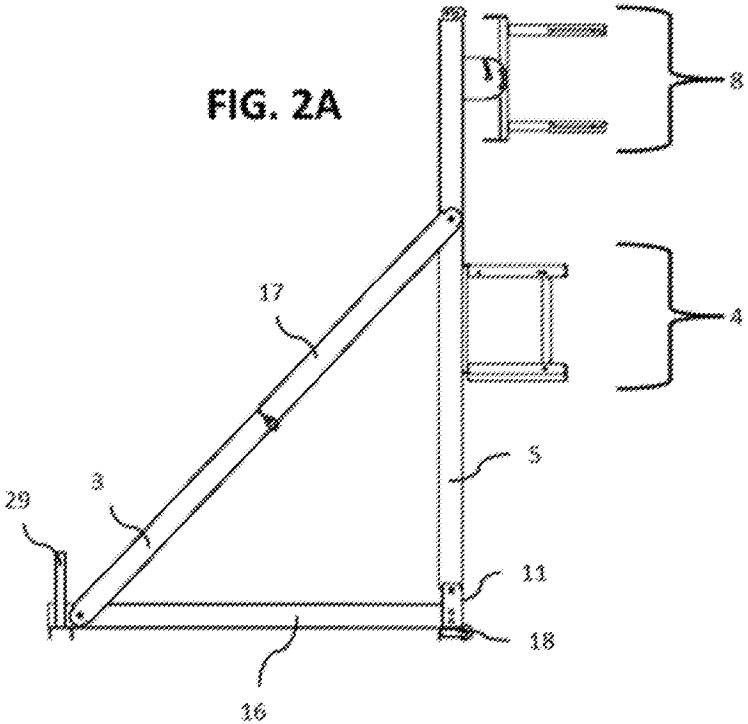
FIG. 2A shows one embodiment of the apparatus of the present invention from a side view.
Figure 2C:
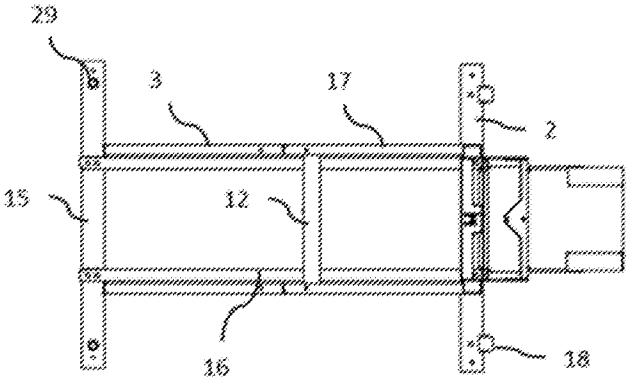
FIG. 2C shows one embodiment of the apparatus of the present invention from a top view.

Generally speaking, the present invention is directed to a board holding apparatus useful for martial arts training that is configured to hold one or multiple boards in different positions (using selectively attachable station assemblies, each station assembly providing training in a unique technique and/or position), allowing martial artists to use a variety of foot and hand techniques for training or demonstration purposes. The board holding apparatus is made up of three major components: a support frame 1, a first station assembly 4 configured to be removably attached to the support frame 1 at a first position, and a second station assembly 8 configured to be removably attached to the support frame 1 at a second position. In one embodiment, the first station assembly 4 and second station assembly 8 are configured to be attached to the support frame 1 at the same time (as shown in the figures). In an alternative embodiment, each station may be connected to the support frame 1 (and thus used by the user) at different times. Each station assembly has a unique configuration allowing the user to select the appropriate station for desired use (as described more fully below). In addition, in one embodiment the apparatus may utilize an overhead holder 28 to provide a third training area that is suspended from the support frame 1, providing a third station for training of a third skill. Generally, the apparatus may be deployed in either a free-standing mode with the support-frame 1 including various surface level supports 2, 15, 16, and weights 29 to hold the apparatus in place (as shown, for example, in FIGS. 1-2C and 8-9C) or in a version using only a portion of the support frame 1 (as shown, for example, in FIGS. 3A-3C), which is intended to be mounted to a vertical surface.

Turning to the figures, the support frame 1 may be described more fully. As shown in FIGS. 1-2C and 8-9C the free-standing version of the board holding apparatus includes supports 2, 15, 16 for positioning the support frame 1 on a flat surface. The removal of these supports allows for the mounting of the support frame 1 to a vertical surface, such as a wall. As shown, the free-standing embodiment of the support frame has two crossbeam supports 2, 15 (shown in detail in FIGS. 19 and 20) and two lengthwise supports 16 (shown in detail in FIG. 21) extending between and connecting the crossbeam supports 2, 15. For reference herein, the crossbeam supports 2, 15 may be individually described as a front crossbeam support 2 and a back crossbeam support 15, while one of the lengthwise supports 16 may be described as a left lengthwise support and the other a right lengthwise support. Front crossbeam support 2, in one embodiment, may include a number of components allowing the attachment of wheels 18 to the front crossbeam support 2, discussed more fully below. These crossbeam supports 2, 15 and lengthwise supports 16 connect to form the base of the support frame. In one embodiment, lengthwise supports 16 are hingedly connected to the front crossbeam support 2 such that the base may be folded up for transport or storage of the apparatus.

Figure 23:
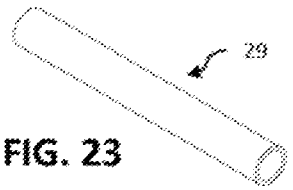
FIG. 23 shows one embodiment of the weighted tube weight holder of the support frame.

In the preferred embodiment, the crossbeam supports 2, 15 are configured to rest on the floor, while the lengthwise supports 16 rest on top of the crossbeam supports 2, 15. The crossbeam supports 2, 15 are placed at opposite ends of the lengthwise supports 16, with the crossbeam supports 2, 15 extending perpendicular to the lengthwise supports 16. The ends of the lengthwise supports 16 rest on a middle area on the top side of the crossbeam supports 2, 15 such that the ends of the crossbeam supports 2, 15 extend outwardly past the ends of the lengthwise bars 16. FIG. 23 shows a weight plate tube 29 that may be attached at the rearward end of the supports (for example on the back crossbeam support 15) such that the tube 29 extends upwardly. Weighted plates (not shown) may be slid in place over the weight plate tube 29 in order to more securely hold the apparatus in place when in use. The added weight is thus a safety factor, preventing the apparatus from tipping over due to the force of a martial artist striking boards when using the apparatus.

Figure 16:
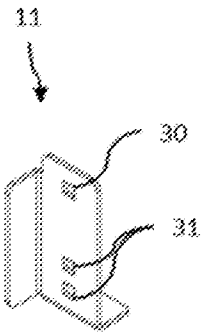
FIG. 16 shows one embodiment of the upright support brace of the support frame.

Extending upwardly from the base of the support frame at one end (herein after referred to as the "front end") of the support frame is a pair of vertical upright main supports 5 (shown in detail in FIG. 10). These upright main supports 5 extend vertically from the position on the front crossbeam support 2 where the lengthwise supports 16 rests upon the front crossbeam support 2. A support brace 11 (shown in detail in FIG. 16) may be used to attach the upright main supports 5 to the front crossbeam support 2 and lengthwise support 16 in order to strengthen the attachment of the upright main support 5. Each support brace 11 has an aperture 30 for receiving an attachment means (such as a screw, bolt, etc.) configured to connect the support brace 11 to the corresponding upright support 5, a pair of apertures 31 for connecting the support brace 11 to the lengthwise support 16, and a second set of apertures (not shown in the drawing) for connecting the support brace 11 to the front crossbeam 2, thus facilitating a secure connection between the various components 2, 5, 16. As shown, the vertical upright main supports 5 are only positioned at one end of the support frame (the front end). The upright vertical main supports 5 incorporate key lock holes 32 along the vertical length of the upright vertical main supports 5 (as shown in detail in FIG. 10). These key lock holes 32 allow for the holding stations 4, 8 (discussed more fully below) to be adjustable to accommodate a variety of heights, by allowing for the holding stations 4, 8 to be positioned at different positions along the height of the main supports 5.

A pair of angled lock bars extends at an angle from the back end of the support frame (such as, for example, a rearward point near the position where the lengthwise supports 16 attach to the back crossbeam support 15) and attach at a point approximately three-quarters of height of the upright vertical main supports 5, as shown in FIG. 1. Each of the angled lock bars includes two components: a lower end lock bar 3 and an upper end lock bar 17 (shown in detail in FIG. 14). For each of the angled lock bars, the lower end lock bar 3 connects at one end to the outer surface of the back end of the lengthwise supports 16 (with a left lock bar connecting to the left lengthwise support and a right lock bar connecting to the right lengthwise support). Likewise, for each angled lock bar, each upper end lock bar 17 (one left and one right) connects at one end to vertical upright main support 5 (with, of course, the left lock bar connecting to the left vertical support and the right lock bar connecting to the right vertical support). The two lock bar components 3, 17 (both on the left and right side of the support frame) are hingedly attached to one another at their other ends, thereby forming a full lock bar assembly extending from the back end of the support frame to the front end (at the vertical upright supports 5).

Figure 15:
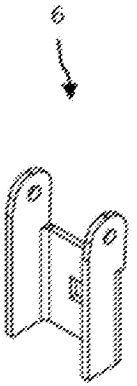
FIG. 15 shows one embodiment of the wheel attachment piece of the support frame.

The lockbar serves to keep the support frame from folding when in use, but the hinged connection allows the lock bars to bend in the middle, thereby allowing the support frame to collapse and become portable when not in use. A folding beam brace 12 may be positioned between the left lock bar and right lock bar to facilitate the folding of the lock bars and support frame. In order to facilitate easy mobility, the base may integrate a set of wheels 18 on the same crossbeam support 2 where the vertical upright supports 5 are positioned (keeping with consistent language used herein, the front crossbeam support 2). The wheels 18 allow the support frame to be rolled around when the frame has been collapsed. The wheels 18 may be attached to the crossbeam support 2 using a wheel mount 6, which is shown in FIG. 15. The vertical upright supports 5 have a crossbar extending between them at the top 7, which can be used as a handle to facilitate movement of the frame.

Figure 20:
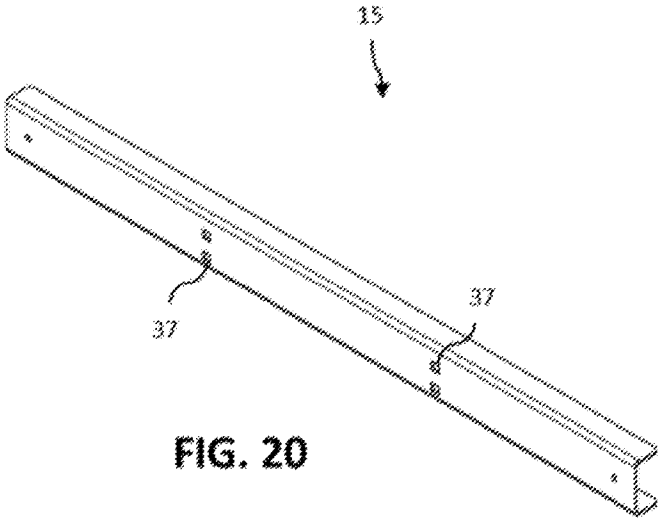
FIG. 20 shows one embodiment of the back crossbeam support of the support frame.
Figure 21:
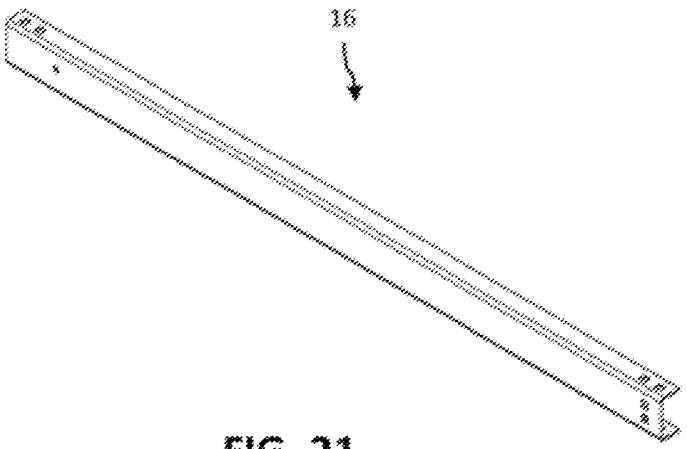
FIG. 21 shows one embodiment of the lengthwise support of the support frame.
Figure 19:
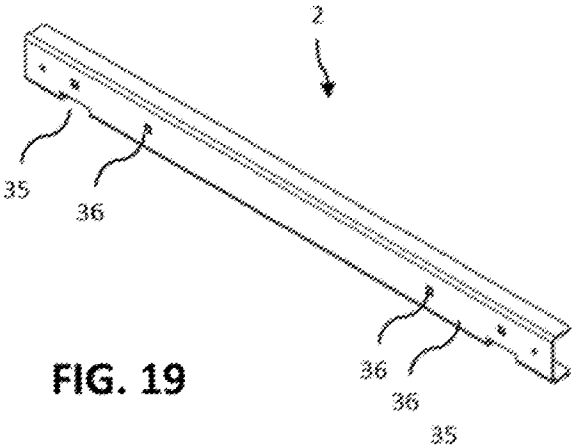
FIG. 19 shows one embodiment of the front crossbeam support of the support frame.

The front crossbeam support 2 is shown in more detail in FIG. 19. As shown, the preferred embodiment of the crossbeam support 2 is a U-shape sturdy beam having two ends and a body extending therebetween. At two positions (one near each end of the support 2), the body of the crossbeam support 2 has recesses 35 for receiving the wheel holders 6 and wheels 18. The top surface of the support 2 includes a number of apertures 36 for receiving attachment means utilized to connect the support 2 to the upright vertical supports 5 and to the lengthwise supports 16 as described above. In one embodiment, the attachment of these components to the support 2 may be facilitated by the support brace 11 shown in FIG. 16, as described above. As shown in FIG. 20, the back crossbeam support 15 has a similar configuration as front crossbeam support 2. However, in the preferred embodiment, as shown, the back crossbeam support 15 does not include wheels (thus allowing the support frame 1 to maintain its position on the flat surface when in use, such that in order to utilize the wheels the non-wheel back end 15 must be lifted from the ground such that the weight of the support frame 1 is shifted to the wheeled front end 2 for rolling). Back crossbeam support 15 has sets of apertures 37 to receive attachment means configured to attach the lengthwise supports 16 to the back crossbeam support 15 as discussed above.

Figure 14:
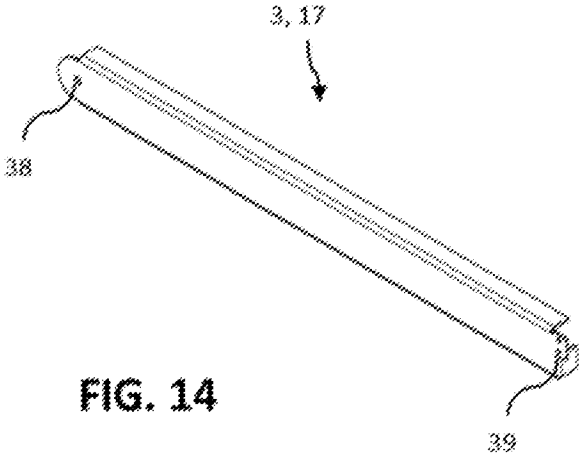
FIG. 14 shows one embodiment of the upper and lower breakaway folding beams of the support frame.
Figure 17:
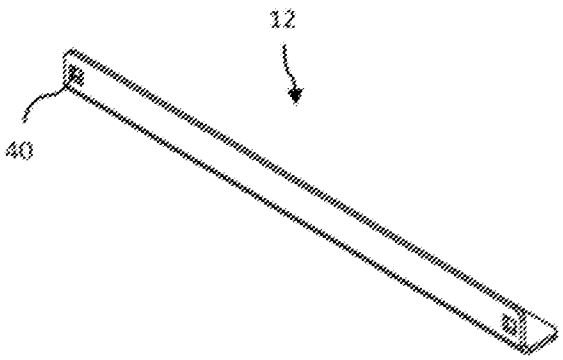
FIG. 17 shows one embodiment of the folding beam brace of the support frame.

The lock beam support components (lower 3 and upper 17) may be described in more detail with respect to FIG. 14. As shown, each of the components 3, 17 has an elongated body with one end having an aperture 38 for receiving an attachment means for attaching the lock beam to the support frame 1 and the other end a hinge attachment piece 39 for hingedly attaching the component to its counterpart (i.e. the lower 3 to the upper 17, and the upper 17 to the lower 3). Each of the components 3, 17 also has an aperture (not shown) for receiving an attachment means configured to connect the folding beam brace 12 to the corresponding component 3, 17. As shown in FIG. 17, the folding beam brace 12 has corresponding apertures 40 to facilitate the connection to both the left lock bar components (upper 17 and lower 3) and right-side lock bar components.

Figure 11:
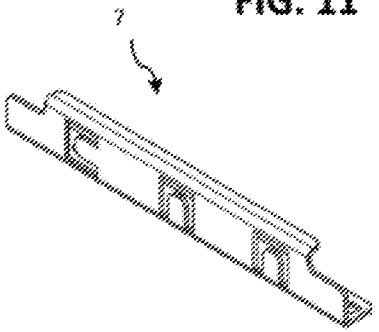
FIG. 11 shows one embodiment of the crossbar of the support frame.
Figure 10:
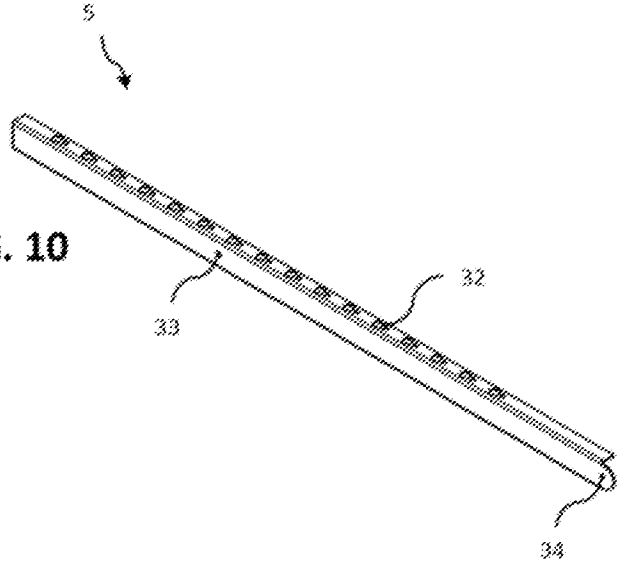
FIG. 10 shows one embodiment of the upright support of the support frame.
Figure 18:
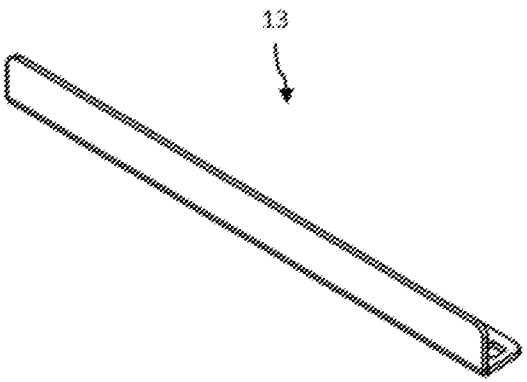
FIG. 18 shows one embodiment of the crossbar brace of the support frame.

FIG. 10 shows detailed views of the vertical upright supports 5 of the support frame 1. As shown, the vertical upright supports 5 are elongated structures having at least two surfaces. A first surface (the face surface, for example) includes a number of key locks 32 starting at one end (the upper end) of the support 5 and continuing at spaced apart distances to near the other end (bottom) of the support 5. The key locks 32 provide several heights at which the different stations may be attached. Each upright support 5 also includes a number of apertures for connecting the support 5 to other components of the support frame. A first aperture 33 is located approximately three-quarters of the way up on the upright support 5 and is used to connect the upright 5 to the upper lock bar cornponent 7, as described above. A second aperture 34, located at or near the bottom end of the upright support 5 is used to connect the upright support 5 to the lengthwise bar 16, allowing the upright 5 to extend vertically from the base of the support frame 1. The cross bar 7 (which is shown in FIG. 11) connects the left and right upright supports 5 to provide additional support for the vertical uprights 5. A number of crossbar supports 7 may be used at different points along the height of the uprights 5, with the top most crossbar 7 capable of being used as a handle during movement of the support frame 1. A bottom upright brace 13 (shown in FIG. 18) may be positioned near the bottom of the uprights 5 and used in a similar manner to crossbars 7 to connect the two uprights 5 to provide for a more secure frame 1.

Figure 3C:
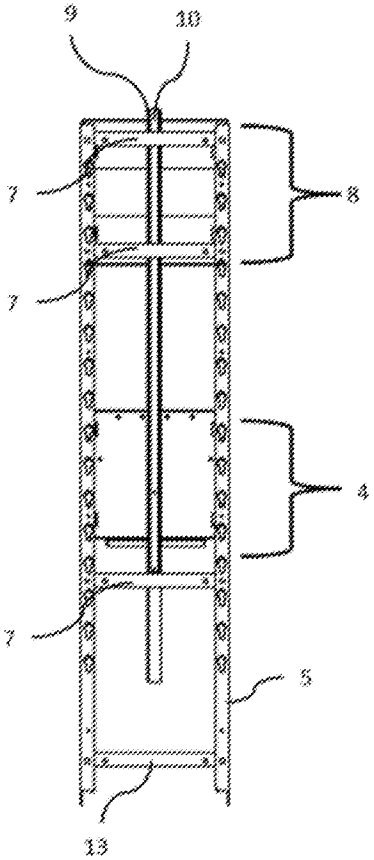
FIG. 3C shows one embodiment of the present invention from a back view.
Figure 3B:
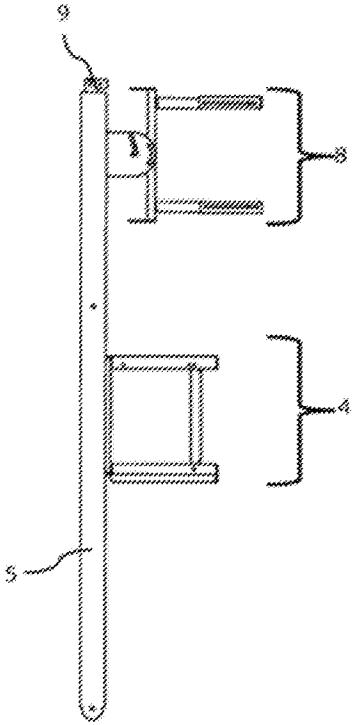
FIG. 3B shows one embodiment of the present invention from a side view.
Figure 3A:
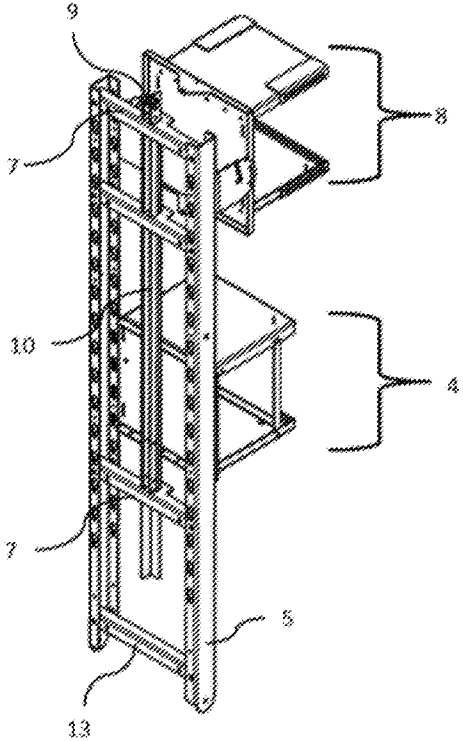
FIG. 3A shows one embodiment of the apparatus of the present invention form a back perspective view.
Figure 13:
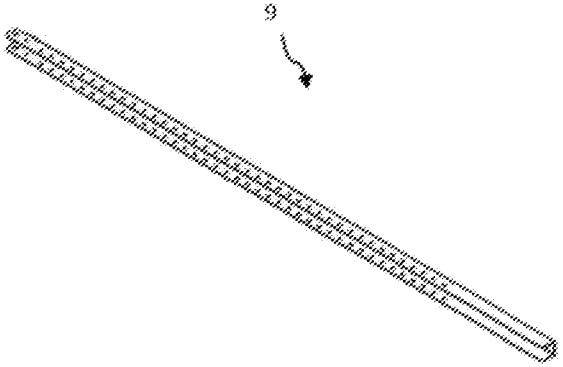
FIG. 13 shows on embodiment of the swing arm channel of the support frame.

FIG. 13 shows the vertical center channel 9 of the support frame 1, which is also shown in FIGS. 1-2C and 8-9C (assembly with full support frame 1 for use on a horizontal surface) and FIGS. 3A-3C (assembly without portions of support frame for mounting to a vertical surface). The vertical center channel 9 is positioned between the vertical upright supports 5 and is configured to extend parallel to the uprights 5, as shown. An extending arm 10 is attached to this vertical channel 9 and is configured to extend outward in a direction perpendicular to the vertical channel 9, as shown, for example, in FIGS. 8-9C. The outwardly extending bar 10 (shown in FIG. 12) is configured to hold the overhead quick break holder 28 or individual boards with a plate and screw and is configured to be positioned at different angles from the center channel 9.

Figure 4:
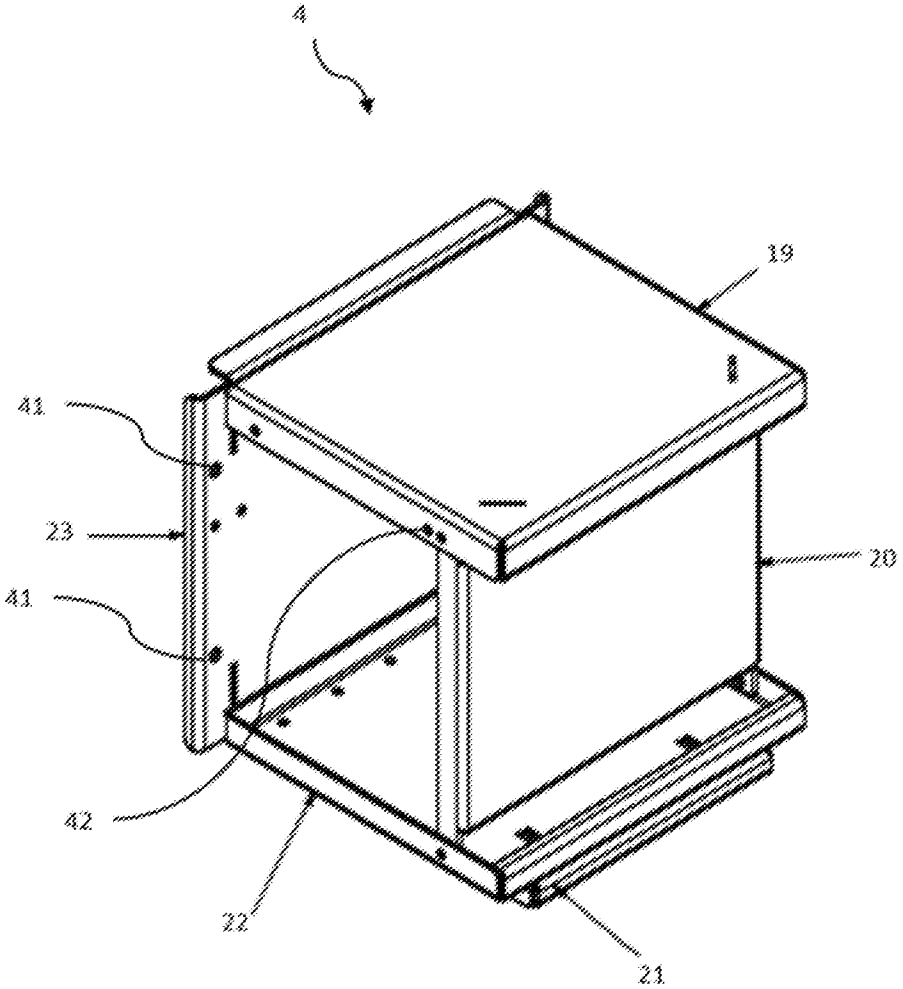
FIG. 4 shows one embodiment of the first station assembly of the present invention.
Figure 5C:
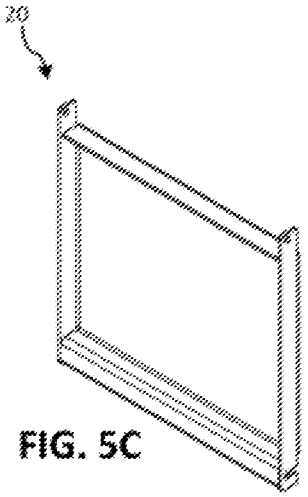
FIG. 5C shows one embodiment of the kick plate of the first station assembly.
Figure 5E:
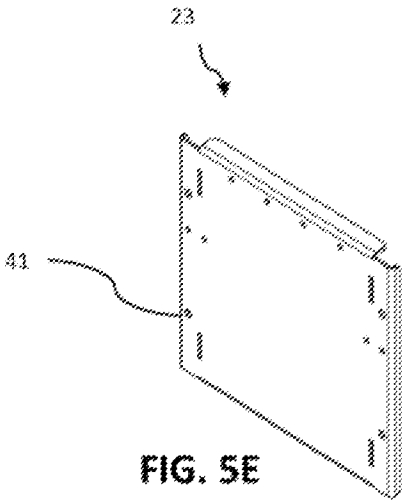
FIG. 5E shows one embodiment of the back plate of the first station assembly.
Figure 5B:
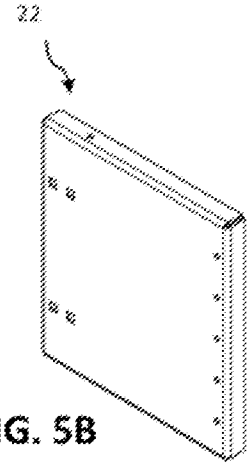
FIG. 5B shows one embodiment of the bottom plate of the first station assembly.

Turning to FIGS. 4-5E, the first station assembly 4 may now be described in detail. As indicated above, the various station assemblies 4, 8 may be simultaneously attached to the support frame 1 or may be used at separate times. It should also be noted that the relative positioning of the support assemblies 4, 8 is preferably modifiable. That is, while the first station assembly 4 is shown in the figures as being located at a lower position on the support frame 1 and the second station assembly 8 is shown as being located in a higher position on the support frame 1, the different stations 4, 8 may be moved to different positions to modify the apparatus to the user's desires. As shown, the first station assembly 4 is to be connected to the vertical upright supports 5 of the support frame 1. The first station assembly 4 includes a number of components: a top plate 19 (FIG. 5A), a bottom plate 22 (FIG. 5B), a kick plate 20 (FIG. 5C), a back plate 23 (FIG. 5E), and a bottom board rest 21 (FIG. 5D). These components work together to provide the user with a specific training capability.

Figure 5A:
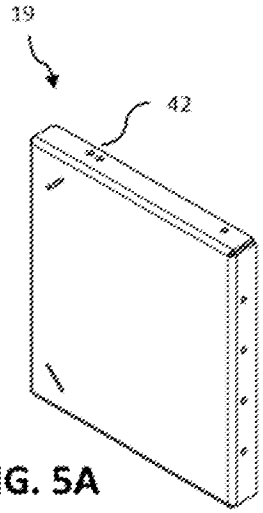
FIG. 5A shows one embodiment of the top plate of the first station assembly.
Figure 5D:
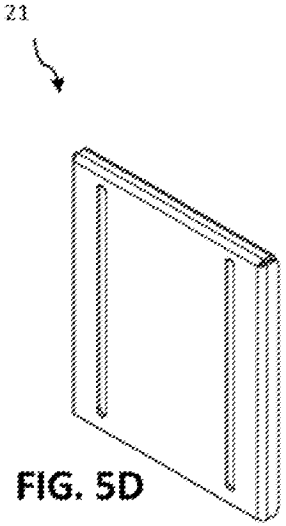
FIG. 5D shows one embodiment of the bottom board rest of the first station assembly.

As shown in FIG. 4, the first station assembly 4 is configured to be attached to the uprights 5 through apertures 41 located in the surface of the back plate 23, thus securing the assembly 4 to the support frame 1. Top plate 19 is configured to be positioned at an upper end of the back plate 23 and bottom plate 22 is configured to be positioned at the bottom end of the back plate 23, as shown in FIG. 4. Each of the top 19 and bottom 22 plates is a generally planar component and these plates 19, 22 are configured to extend outwardly from back plate 23 such that the plates 19, 22 run substantially parallel to one another. Kick plate 20 is also a generally planar plate and is configured to be positioned between the top plate 19 and bottom plate 22 (as shown) such that the planar extent of kick plate 20 runs substantially perpendicular to the planar extents of top plate 19 and bottom plate 22. A quick release pin 42 is positioned on the outer side surface of the top plate 19, as shown in FIGS. 4 and 5A.

For training by the user, the board rest 21 is slid to a position such that it extends past the bottom plate 22 and a board or multiple boards (such as wooden boards that are used for martial arts training, for example) (not shown) are placed such they rest on the board rest 21 (with their planar extents running substantially parallel to the planar extent of the kick plate 20 and substantially perpendicular to the planar extent of the bottom board rest 21). The board (or in the case of multiple boards, the backmost board) is positioned such that its back surface rests on (or at least is positioned near) the kick plate 20 of the assembly. In one embodiment, a strap (not shown) may be included to facilitate holding the boards in place. The user kicks the boards and due to the force of the user's kick, the kick plate 20 (which is hingedly attached to the bottom plate 22) collapses into the station assembly 4. If the force of the kick is strong enough, the boards may break. In one embodiment, the bottom plate 22 is hingedly connected to the back plate 23 and is only being held in the outward extending position (as shown) through its connection to the top plate 19 (which is rigidly affixed in the extended position) by the kick plate 20. When the kick plate 20 collapses (as the force of the kick is sufficient to unlock the release pin 42 attaching the kick plate 20 to the top plate 19), the bottom plate 22 may also collapse as it is no longer being held in the outward position by the rigid top plate 19. This collapse essentially removes the bottom plate 22 and kick plate 20 from the outward position, such that the bottom of the station 4 is no longer in the erect position. This substantially reduces or even eliminates the risk of the kicker's foot getting caught inside the station assembly when the kicker kicks the boards held by the assembly 4. This station 4 is particularly useful for training requiring the user may kick the boards, but it is contemplated that the user may strike the boards with a hand or other tool. In any event, the station 4 essentially functions the same.

Figure 6:
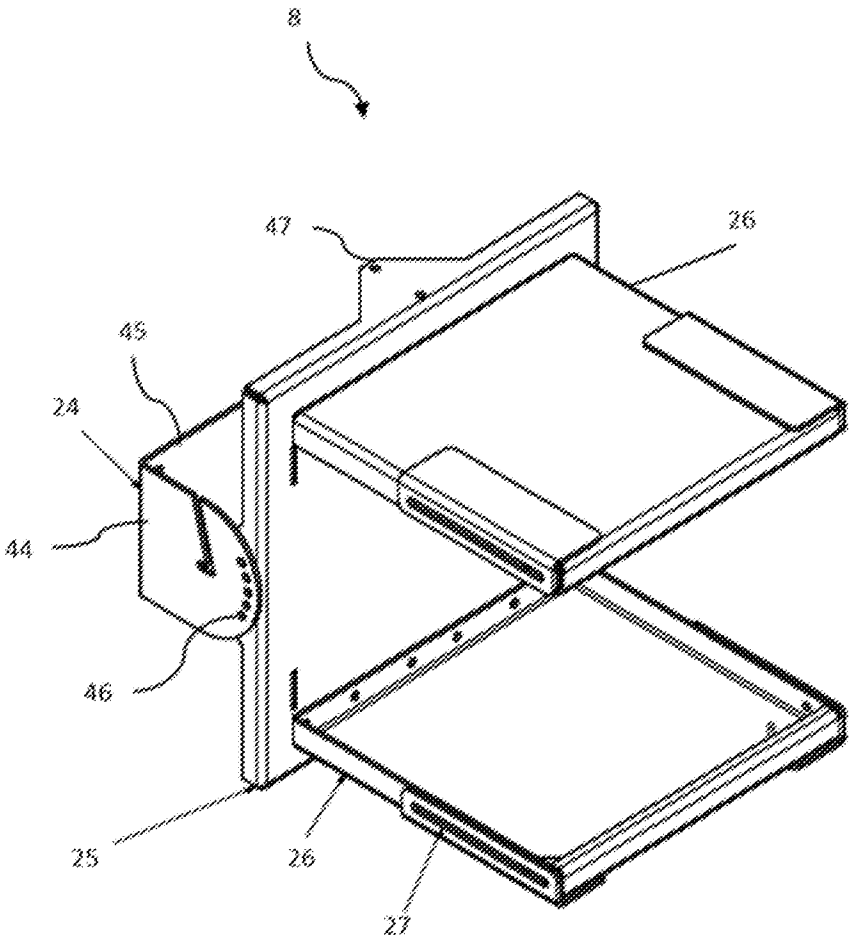
FIG. 6 shows one embodiment of the second station assembly of the present invention.
Figure 8:
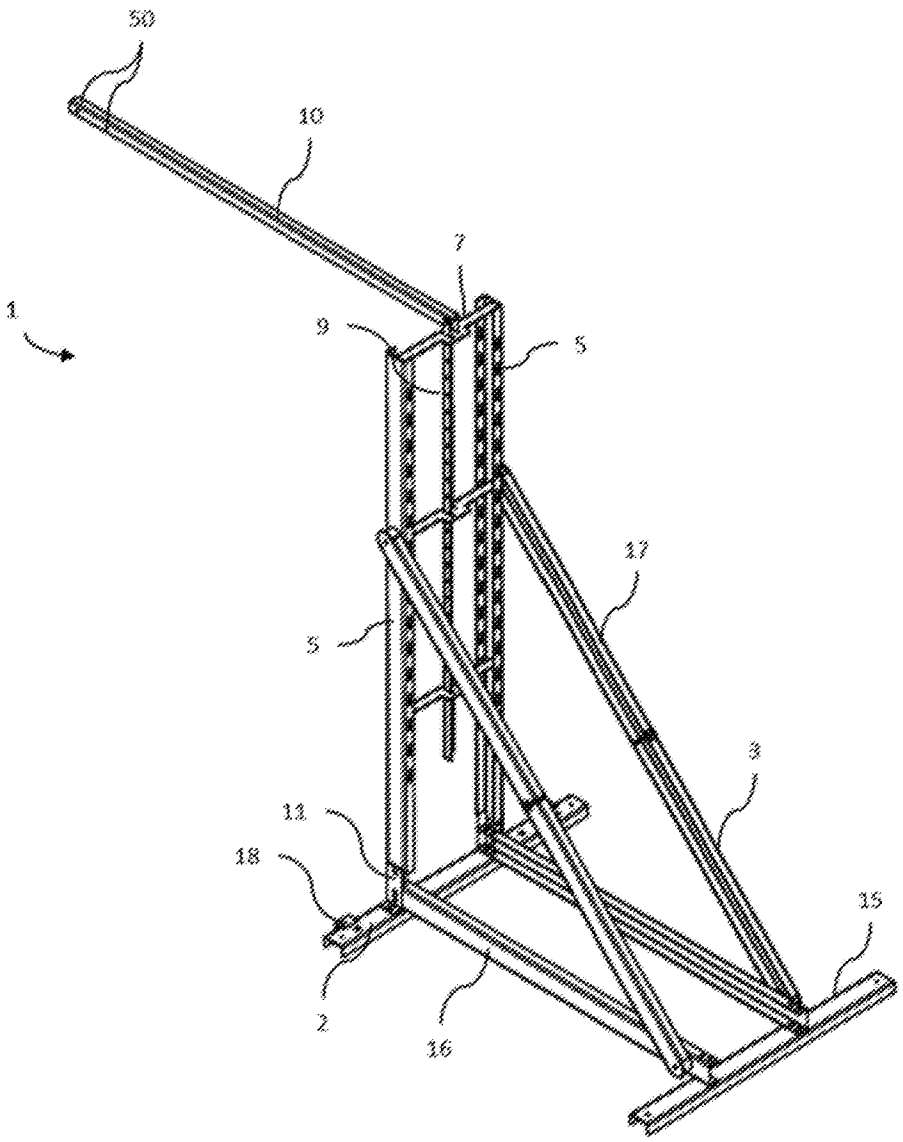
FIG. 8 shows one embodiment of the support frame of the present invention from a back perspective view.
Figure 9B:
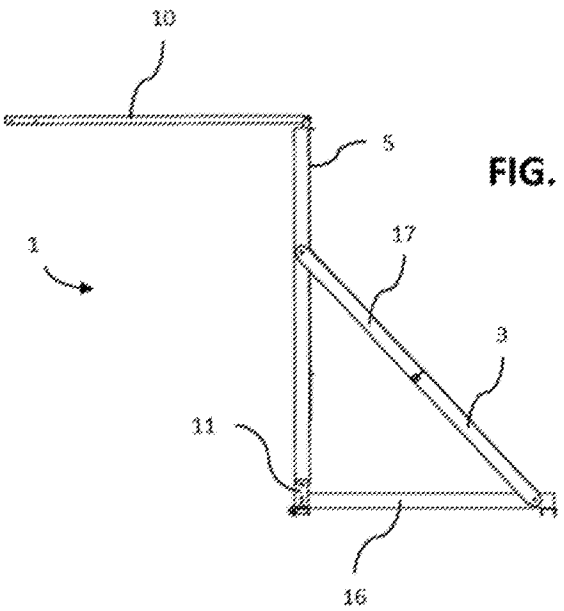
FIG. 9B shows one embodiment of the support frame of the present invention from a side view.
Figure 9C:
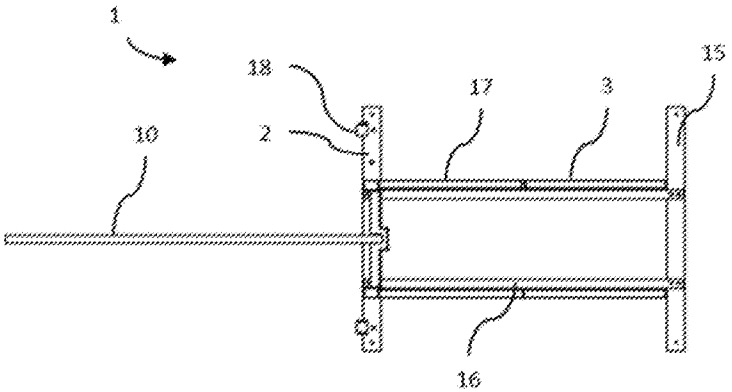
FIG. 9C shows one embodiment of the support frame of the present invention from a top view.
Figure 9A:
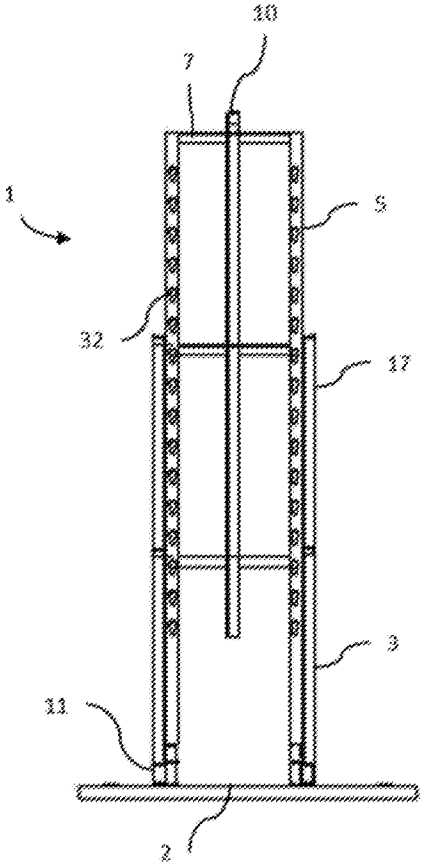
FIG. 9A shows one embodiment of the support frame of the present invention from a back view.

Turning to FIGS. 6 and 7A-7D, the second station assembly 8 may be described in more detail. As shown, the second station assembly 8 includes a number of components: top and bottom plates 26 (FIG. 7C), a back plate 25 (FIG. 7B), a mounting bracket 24 (FIG. 7A), and a board support angle 27 (FIG. 7D). These components work together to provide the user with a specific training capability differing from the first station assembly 4. The mounting bracket 24 is configured to be connected to the support frame 1 in the same manner as the first assembly 4 described above (namely, by attaching the bracket 24 to keyholes 32 of the upright supports 5 of the support frame 1 using attachment means through apertures 43 on the bracket 24). The mounting bracket 24, as shown in FIG. 7A, has two outwardly extending arms 44 extending from its back surface 45. A series of apertures 46 are positioned in the outwardly extending arms 44 and are configured to, through the use of attachment means, connect the back plate 25 to the outwardly extending arms 44 of the mounting bracket 24 (through apertures 47 on the back plate 25). Top and bottom plates 26 are configured to be attached to the back plate 25 such that they extend outwardly from back plate 25, as shown in FIG. 6. The back plate 25 may be attached to the mounting bracket 24 in two directions, allowing the top and bottom plates 26 to extend outwardly such that their planar extent runs horizontal (as shown in FIG. 6) or such that their planar extent runs vertical (not shown)(in the case of vertical positioning, the top and bottom plates may technically become described as left and right plates, as they will no longer be positioned at a top and bottom position). Furthermore, the back plate 25 may be attached at different angles using the various apertures 46 in the mounting bracket 24 such that the angle of extension of the top and bottom plates 26 may be changed.

To use this station 8 for training, boards (not shown) are placed in between the outwardly extending top and bottom plates 26 (or in the event the back plate is turned such that these plates are positioned different, the left and right plates) such that they are held in place spaced apart from the back plate 25. The user strikes the boards, with the force of the strike causing the user to in some cases break the boards, continuing the motion of the strike through the board and into the negative space created by the outwardly extending top and bottom plates 26. It may be seen that this particular station 8 may be useful for striking with a hand, foot, or other tool. As indicated above, this station 8 allows for striking of boards in different positions (vertical or horizontal) and at different angles, providing a variety of training options.

Figure 12:
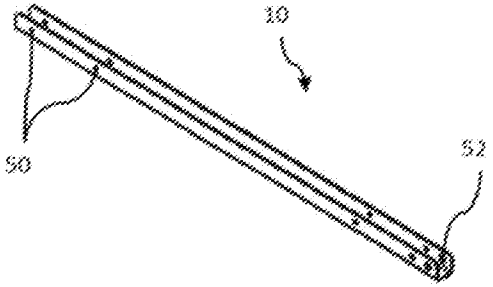
FIG. 12 shows one embodiment of the swing arm of the support frame.
Figure 22:
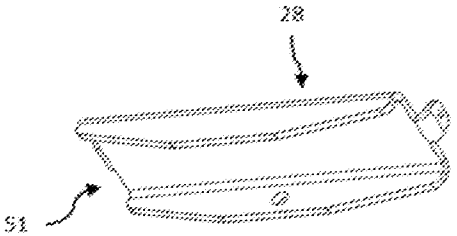
FIG. 22 shows one embodiment of the overhead quick break holder.
Figure 24:
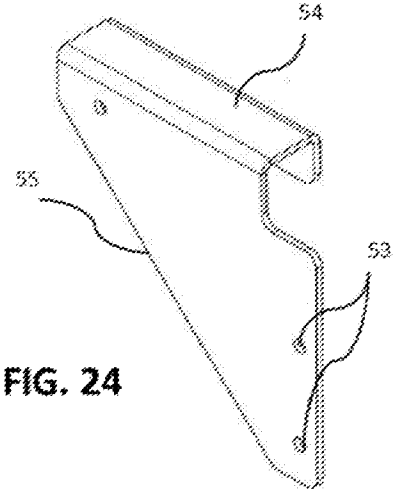
FIG. 24 shows one embodiment of a stiffener for use with the overhead quick break holder.
Figure 25:
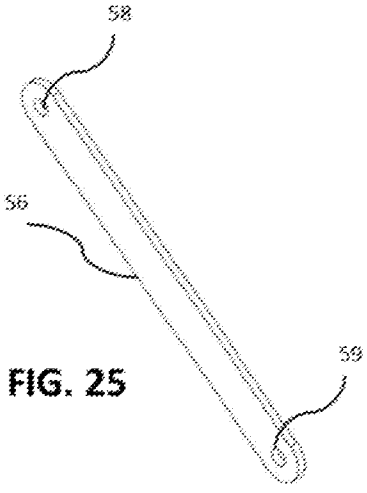
FIG. 25 shows a second embodiment of a stiffener for use with the overhead quick break holder.
Figure 26:
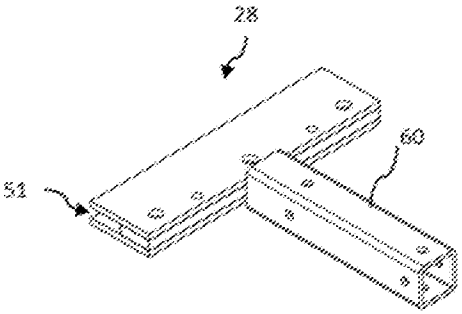
FIG. 26 shows a second embodiment of the overhead quick break holder.

FIG. 22 and FIG. 26 each show various embodiments of the overhead quick break holder 28, and FIG. 12 shows the extension bar 10 that extends form the top of the support frame 1 to hold the overhead quick break holder 28 (not shown in this configuration). The extension bar 10 extends well in front of the apparatus (as shown, for example, in FIG. 8), and provides two connection points 50 for attaching means to connect the extension bar 10 to the quick break holder 28. As a result, the quick break holder 28 is in one embodiment (FIG. 22) simply suspended from the extension bar 10 or in another embodiment (FIG. 26) slid onto the extension bar 10 by inserting the extension bar 10 into a hollow extension 60 of the quick break holder (FIG. 26). In one embodiment (FIG. 26), boards are then placed within the slot 51 of the quick break holder 28, extending outward (in a horizontal plane or vertical plane) from the slot 51 of the quick break holder 28, allowing the user to strike the boards with a hand, foot, or other tool. Alternatively (FIG. 22) the boards may be suspended from the quick break holder 28 and used in a similar manner. These boards may be held in place by a bolt or similar means. When deployed in this manner, a martial artist may strike the boards from underneath or from the side, for example, in order to break the boards while the boards are suspended outwardly from the quick break holder 28. This is a different challenge for the martial artist, because the boards in this case are not held firmly at each end, but rather are secured on one end of the holder at a high position relative to the martial artist. The extension bar 10 may be easily removed from the apparatus with a pin for take-down or reconfiguration. In one embodiment, one or more stiffeners may be used with the apparatus in order to keep the overhead quick break holder 10 stable. One or both of two types of stiffeners may be used, each shown separately in FIG. 24 and FIG. 25. As shown in FIG. 24, one stiffener type attaches to the upright main supports 5 using apertures 53 and has a rigid surface 55 that extends outwardly from the upright supports. A cupping lip 54 of the stiffener extends around the extension bar 10 to keep the extension bar 10 from moving vertically or horizontally when in use. A second stiffener, as shown in FIG. 25, works to secure the extension bar 10 at the appropriate angle for use of the overhead quick break holder 28. This locking stiffener has an elongated surface 56 separating a first aperture 59 (for connecting the stiffener to the support frame 1, and more preferably the upright support 5 of the support frame 1) and a second for connecting to the extension bar 10 of the quick break holder thereby keeping the extension, arm extended at a secured angle. In the preferred embodiment, two of these locking stiffeners (FIG. 25) are used—one on each upright support 5. Furthermore, it is preferred that both types of stiffeners (FIG. 24 and FIG. 25) be used to make the quick break holder 28 most secured.

In one alternative embodiment (not shown), the apparatus allows the stations 4, 8 to glide and lock in a channel, and also to swivel, as desired by the user. An insert with a glide mechanism may be employed, which may use, for example, wheels or hydraulics. The station may lock through key locks from the front panel as in other embodiments. A heavy-duty swivel mechanism may be incorporated into, for example, the second station, allowing it to be rotated to a desired orientation for use.

Unless otherwise stated, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein. It will be apparent to those skilled in the art that many more modifications are possible without departing from the inventive concepts herein.

All terms used herein should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. When a Markush group or other grouping is used herein, all individual members of the group and all combinations and subcombinations possible of the group are intended to be individually included. All references cited herein are hereby incorporated by reference to the extent that there is no inconsistency with the disclosure of this specification. When a range is stated herein, the range is intended to include all sub-ranges within the range, as well as all individual points within the range. When "about." "approximately," or like terms are used herein, they are intended to include amounts, measurements, or the like that do not depart significantly from the expressly stated amount, measurement, or the like, such that the stated purpose of the apparatus or process is not lost.

The present invention has been described with reference to certain preferred and alternative embodiments that are intended to be exemplary only and not limiting to the full scope of the present invention.

The invention claimed is:

1. A martial arts training apparatus, the apparatus comprising:

a. a support frame, wherein the support frame comprises at least one upright support; and b. at least one of a first station assembly and a second station assembly configured to be attached to the at least one upright support of the support frame, wherein the first station assembly comprises:

a. a top plate configured to be rigidly connected to the at least one upright support of the support frame;

b. a bottom plate; and c. a kick plate hingedly connected to the bottom plate and detachably connected to the top plate, thereby detachably connecting the bottom plate to the top plate, wherein the first station assembly is configured to receive one or more boards, further wherein the kick plate is configured to detach from the top plate upon an application of force on the one or more boards, further wherein the bottom plate is configured to collapse upon the detachment of the kick plate from the top plate, and wherein the second station assembly comprises a first plate and a second plate further wherein the first plate and second plate are separated by negative space configured to receive one or more boards.

2. The apparatus of claim 1, wherein the first station assembly further comprises a back plate configured to be removably affixed to the at least one upright support of the support frame, wherein the top plate is rigidly connected to the at least on upright support through the back plate.

3. The apparatus of claim 1, wherein the first station assembly further comprises a board rest plate positioned below the bottom plate, the board rest plate configured to hold the one or more boards.

4. The apparatus of claim 1, wherein the second station assembly further comprises a back plate, wherein each of the first plate and the second plate is configured to be attached to the back plate, further wherein each of the first plate and second plate is configured to extend from the back plate in a planar extent.

5. The apparatus of claim 4, wherein the second station assembly further comprises a mounting bracket, wherein the back plate is configured to be connected to the mounting bracket.

6. The apparatus of claim 5, wherein the mounting bracket is configured to be selectively positioned at one of a number of angles, thereby positioning the back plate at the selected angle, thereby selectively positioning the planar extent of the first plate and second plate at the selected angle.

7. The apparatus of claim 1, wherein the support frame further comprises a support base configured to rest on a horizontal surface.

8. The apparatus of claim 7, the at least one upright support is hingedly connected to the support base.

9. The apparatus of claim 8, wherein the support frame further comprises at least one foldable lockbar extending between the support base and the at least one upright support, wherein the foldable lockbar is configured to selectively move the support frame between a locked position and a foldable position.

10. The apparatus of claim 1, further comprising an extendable arm hingedly attached to the support frame and configured to extend outwardly from the support frame.

11. The apparatus of claim 10, further comprising a third station assembly configured to be removably attached to the extendable arm.

* * * * *